United States Patent [19]

Nielsen

[11] 4,067,679

[45] Jan. 10, 1978

[54] MACHINE FOR MAKING CONCRETE PIPES IN UPRIGHT POSITION

[75] Inventor: Jens Peter Nielsen, Bronderslev, Denmark

[73] Assignee: Pedershaab Maskinfabrik A/S, Bronderslev, Denmark

[21] Appl. No.: 725,199

[22] Filed: Sept. 21, 1976

[30] Foreign Application Priority Data

Sept. 25, 1975 Denmark ..... 4311/75

[51] Int. Cl.[2] ..... B28B 3/02; B28B 21/50

[52] U.S. Cl. ..... 425/421; 425/432

[58] Field of Search ..... 425/262, 421, 424, 432, 425/456; 249/100

[56] References Cited

U.S. PATENT DOCUMENTS

| | | | |
|---|---|---|---|
| 3,119,165 | 1/1964 | Gourlie | 425/421 |
| 3,177,554 | 4/1965 | Larkfeldt | 425/456 |
| 3,201,843 | 8/1965 | Osweiler | 425/421 |
| 3,273,216 | 9/1966 | Gourlie | 425/432 |
| 3,696,182 | 10/1972 | Joelson | 425/424 |

FOREIGN PATENT DOCUMENTS

| | | | |
|---|---|---|---|
| 1,051,184 | 2/1959 | Germany | 425/262 |

*Primary Examiner*—Francis S. Husar
*Assistant Examiner*—John McQuade
*Attorney, Agent, or Firm*—Owen, Wickersham & Erickson

[57] ABSTRACT

In a concrete pipe moulding machine comprising a rotationally vibrated core and an outer mould, deficiencies may occur especially in the upper ends of the moulded pipes due to rather vigorous relative movements between the core and the outer mould. Means are provided to moderately reduce these relative movements by neutralizing the tendency of the outer mould to perform a rocking motion caused by the transmission of the rotating vibration forces via the moulding material onto the outer mould.

8 Claims, 3 Drawing Figures

FIG. 1
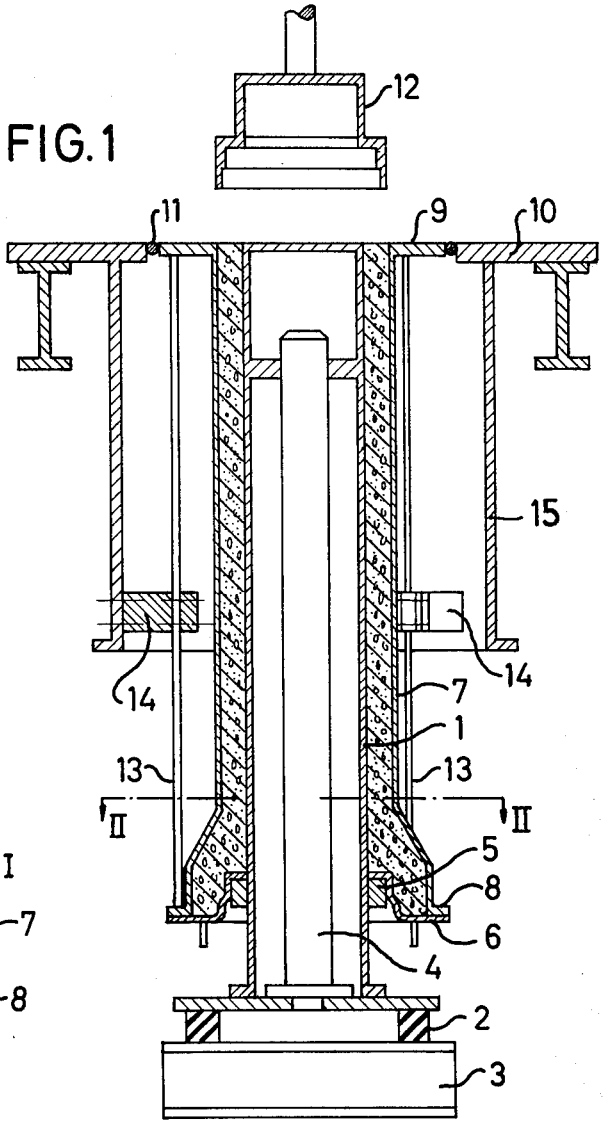
FIG. 2
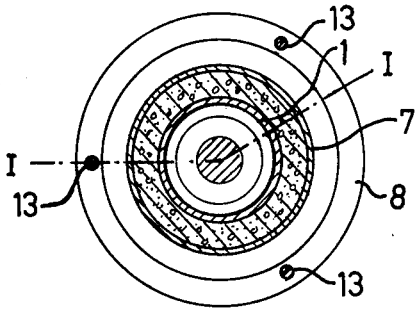
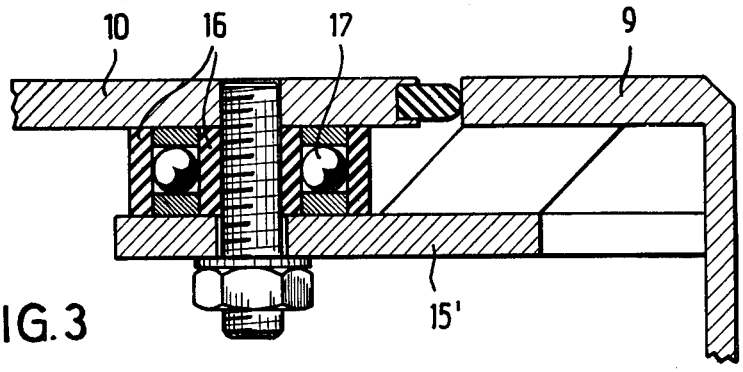
FIG. 3

MACHINE FOR MAKING CONCRETE PIPES IN UPRIGHT POSITION

BACKGROUND OF THE INVENTION

In the production of concrete pipes in upright position in existing pipe moulding machines comprising an elastically supported outer mould and a horizontally vibrated inner mould or core, it often depends on chance whether or not the pipes obtain the desired quality as relates mechanical strength, watertightness and surface finish. More particularly, deficiencies in the form of lack of tightness may appear in the upper end portion of the pipe being moulded, and in such case a closer examination of the defective pipes usually discloses stone accumulations, also known as stone nests, which indicate that the vibration in the zone or zones in question has caused separation of the moulding materials, rather than the intended packing or compacting thereof. As indicated, the deficiencies cannot be characterized as systematic because the majority of the manufactured pipes will normally satisfy the quality requirement and, therefore, there has been considerable uncertainty on the real cause of the moulding deficiencies. It has further been ascertained that a given machine may operate satisfactorily with equipment for some nominal pipe diameters but results in a relative high percentage of scrap with equipment for other diameters, in particular smaller diameters, which has not either been explicable in a satisfactory way.

By the pipe making, fresh concrete is poured into the cavity between the outer mould and the core after the vibration of the core has started. The vibration depends on forces which through upper and lower vibrator bearings are transmitted to the core and which rotate in horizontal planes so as to cause a circular movement of the core. Equipment which operates in this manner is commonly used in the pipe moulding art and is shown, for example, in U.S. Pat. Nos. 3,177,554 and 3,201,843. Eccentric elements on a vertical axis of rotation are positioned within and connected through bearings to the inside of the core moulding member. Rotation of the eccentric elements effects a rotational vibration of the core member, i.e. the core does not rotate about its axis, but each point on the core rotates in a small horizontal circle, following the eccentric vibration of the eccentric elements. Via the poured concrete, and to a certain degree also by other ways, the vibration forces are transmitted onto the outer mould which is therefore also subjected to a circular motion. The frequency of this motion is similar to that of the core, whereas the motions differ as relates their amplitude, i.e. the radii of the circular motions, and their phase. Therefore, a relative movement will occur between the outer mould and the core, which is mainly a radially directed movement but also includes a tangential component. Accordingly, the moulding mass is subjected to oscillating pressure and pull forces intended to cause a rearrangement and packing or compacting of the material, and at the same time the tangential movement may result in a displacement between the moulding mass and the cavity walls.

For obtaining a satisfactory packing, the concrete mass being vibrated must be subjected to a certain power or inertia and, at the same time, a static pressure should be exerted on the mass so as to secure that the vibration does result in the desired packing rather than in a simple pulsating movement that can lead to a separation of the components of the mass and the formation of the stone nests referred to in the foregoing. In the lower regions of the mould, e.g. more than 20 to 30 cm below the concrete level, the weight of the superposed material may be sufficient to provide the required static pressure, whereas the vibration forces in the upper region of the mould may cause a loosening of the material rather than a compacting thereof. This tendency becomes more marked with increasing vibration power, which could point to a reduction of the vibration effect which, however, does not lead to a satisfactory solution because the reduced pressure level is accompanied by a poorer quality. Instead thereof, in the last phase of the moulding operation a pressing and smoothing head has been used which is pressed down into the upper end of the moulding cavity to cause an ironing of the concrete surface and to exert a static pressure thereon. For this purpose it is necessary that the pressing and smoothing head fits almost like an annular piston in the cavity and, accordingly, will form a rather rigid connection between the outer mould and the core so that, generally, these elements will move together. This means that the relative movement between the outer mould and the core and, therefore, the dynamic influence on the moulding mass is drastically reduced. The remaining (static) pressure will cause only a poor compacting, and the concrete quality in the upper portion of the moulded pipe becomes correspondingly poor.

The reduced quality resulting from the less effective compacting would be of minor importance if it were not so that the tendency of material separation and, thus, the formation of the stone nests is very marked in exactly the same portion of the pipe. The separation tendency cannot be eliminated by an increase of the static pressure which does not result in a substantial rearrangement of the material components.

BRIEF DESCRIPTION OF THE INVENTION

An object of the invention is to neutralize the separation tendency so as to permit a powerful vibration without the risk of formation of leaks in the upper portion of the moulded pipes, and to better utilize the static pressure which through the pressing head is exerted on the concrete mass.

Accordingly, the invention relates to a machine for making concrete pipes by moulding in upright position in a mould comprising a rotationally vibrated core, an elastically supported outer mould to which the vibration forces are transmitted mainly through the concrete mass poured into the annular mould cavity, and a pressing head operating in the upper region of this cavity to exert a static pressure on the concrete mass which fills the cavity. According to the invention, such a machine is characterized in that means are provided to cause, prior to the exertion of the static pressure by means of the pressing head, a moderate reduction of the relative movements between the upper portions of the core and the outer mould by supporting the upper end of the outer mould in a rocking resisting manner.

The invention is based on the comprehension that the movements of the core as well as those of the outer mould tend to vary in magnitude and phase from the bottom to the top of the mould which means that the mould parts besides their circular movements are caused to tilt or rock on horizontal axes. The motional differences will result in a particularly high degree of relative movement between the outer mould and the core at their top ends, and although the differences tend to decrease as the mould is being filled with concrete mass, the vibration forces at the top of the mould may be sufficient, even after the complete filling of the mould cavity and after the introduction of the pressing and smoothing head, to cause a loosening of the material components which will become more or less fluidized, rather than being compacted in the manner intended. Now, by the measures of the invention, the basic reason for this occurrence is eliminated or reduced, and it has proved possible to produce pipes of a uniform and high quality over the entire length.

In a preferred embodiment of the machine according to the invention, the outer mould is coupled to the stationary frame of the machine through coupling elements operative to neutralize the phase difference between the mould oscillations at the top and the bottom ends, respectively. The coupling elements restrain the rocking motion of the outer mould, mentioned above, and thereby reduce the undesirable relative movements at the top of the mould.

The coupling elements may expediently comprise at least three preferably parallel stays which connect the end portions of the outer mould and between their ends are fixed in the frame of the machine. During the vibration of the mould, such stays will cause the end portions of the outer mould to perform a translatory motion so as to counteract the rocking tendency.

The same effect for the top end alone, where this effect is particularly wanted, may be obtained by means of coupling elements comprising at least three preferably parallel stays which connect the top end of the outer mould to fixed points of the frame of the machine.

BRIEF DESCRIPTION OF THE DRAWING

On the drawing, the invention is illustrated somewhat diagrammatically.

FIG. 1 is a sectional elevation view of a first embodiment of the invention, as viewed along the line I—I of FIG. 2;

FIG. 2 is a sectional plan view taken along the line II—II of FIG. 1; and

FIG. 3 is a partial elevational section of a second embodiment.

DETAILLED DESCRIPTION OF PREFERRED EMBODIMENTS

The pipe moulding machine comprises, in a conventional manner, a core 1 which through an elastic pad 2 rests on a support 3 and incorporates a vibrator shaft 4. A collar 5 on the core 1 carries a separate bottom ring 6 which cooperates in the shaping of the lower end of the pipe, shown as a bell end. The ring remains on the moulded pipe during its removal from the mould and its hardening period.

The core 1 forms the inner wall of the moulding cavity which on the drawing is filled with concrete and is surrounded by an outer mould 7 having a bottom flange 8 and a top flange 9. The bottom flange 8 rests on the bottom ring 6 which, accordingly, forms a kind of slip coupling through which the vibration movement of the core is transmitted onto the outer mould 7, although the vibration forces are mainly transmitted through the concrete mass which is thereby compacted. In the operative or moulding position shown, the top flange 9 is flush with a frame plate 10 which together with the outer mould may be vertically displaceable for the purpose of uncovering the moulded pipe. The space or slot between the top flange 9 and the plate 10 is closed by a soft packing ring 11.

Above the mould proper, a pressing and smoothing head 12 is shown which after the filling-up of the moulding cavity may be pressed down thereinto to cooperate in the shaping of the spigot end of the pipe.

The bottom and top flanges 8, 9 of the outer mould are interconnected through three longitudinally rigid, vertical rods or stays 13 which are equally angularly spaced around the axis of the moulding equipment and are individually, at an intermediate point, fixed in a carrier block 14 secured to the lower end of a skirt or housing 15 that is integral with the frame plate 10. The purpose and the effect of the stays 13 appear from the foregoing explanation, which also indicates that the lower parts of the stays, i.e. the parts extending from the carrier blocks 14 to the bottom flange 8, could be omitted. In such case the remaining stay portions will resist any rocking tendency imparted to the top flange of the outer mould without preventing a limited horizontal translational movement thereof.

A similar effect may be obtained by the embodiment of FIG. 3 in which the top flange 9 is connected to an annular plate 15' that again is coupled to the frame plate 10 through at least three flexible coupling elements, of which only one is seen in the figure. Each coupling element includes a pair of concentric annular damper members 16 of a flexible material, e.g. rubber, and an interposed axial bearing that is illustrated as a ball bearing 17. This bearing resists any rocking tendency of the top flange 9 independent of the radially directed resistance, by the damper elements, against horizontal translational movements of the flange.

I claim:

1. A machine for making concrete pipes by moulding in upright position in a mould comprising a stationary frame, a rotationally vibrated mould core member, means yieldably supporting the core member on a stationary support, an outer mould, means associated with the core member supporting the outer mould yieldably about the core member, such that the outer mould and the core member are relatively movable horizontally with respect to one another, said outer mould having vibration forces from the mould core member transmitted to it mainly through a concrete mass poured into an annular mould cavity defined between the core member and the outer mould, said vibration forces from the rotationally vibrated mould core member tending to cause relative movement between the core member and the outer mould due to a vibrational phase delay between the core member and the outer mould as the vibration forces travel through the non-rigid unset concrete mass to the outer mould, a pressing head operating in the upper region of the cavity to exert a static pressure on the concrete mass which fills the cavity, and means operative to cause a moderate reduction of the relative movements between the upper portions of the core member and the outer mould, including means connected between the stationary frame and the outer mould for limiting relative movement between the upper portion of the outer mould and the upper portion of the core member and substantially preventing rocking motion of the outer mould with respect to the core member, whereby effective compacting of the upper portions of the concrete pipe is assured.

2. A machine according to claim 1, wherein the outer mould is coupled to the stationary frame of the machine through coupling means operative to neutralize the vibrational phase difference between the mould oscillations at the top and the bottom ends, respectively.

3. A machine according to claim 2, wherein the coupling means comprise at least three preferably parallel vertical stays, each of which connects the ends of the outer mould and is fixed between its ends into the stationary frame of the machine.

4. A machine according to claim 2, wherein the coupling means comprise at least three preferably parallel vertical stays each of which connects the top end of the outer mould to fixed points of the stationary frame of the machine.

5. A machine according to claim 2, wherein the coupling elements comprise at least three radially acting flexible damper elements inserted between the upper end of the outer mould and a surrounding frame plate of the stationary frame, each incorporating an axial bearing resisting axially directed movements between the upper end of the outer mould and the frame plate.

6. A machine for making concrete pipes by moulding in upright position in a mould comprising a stationary frame, a rotationally vibrated mould core member, means yieldably supporting the core member on a stationary support, an outer mould, means associated with the core member supporting the outer mould yieldably about the core member, such that the outer mould and the core member are relatively movable horizontally with respect to one another, said outer mould having vibration forces from the mould core member transmitted to it mainly through a concrete mass poured into an annular mould cavity defined between the core member and the outer mould, said vibration forces from the rotationally vibrated mould core member tending to cause relative movement between the core member and the outer mould due to a vibrational phase delay between the core member and the outer mould as the vibration forces travel through the non-rigid unset concrete mass to the outer mould, a pressing head operating in the upper region of the cavity to exert a static pressure on the concrete mass which fills the cavity, and at least three stays affixed to the outer mould and spaced around its periphery, each extending generally vertically downwardly to a connection with a portion of the stationary frame located above the lower end of the outer mould, said stays being effective to limit relative movement between the upper end of the outer mould and the upper end of the core member and thereby to substantially prevent rocking motion of the outer mould with respect to the core member so that effective compacting of the upper portions of the concrete pipe is assured.

7. A machine according to claim 6, wherein each of the stays continues downwardly from the connection with the stationary frame to a connection with the lower end of the outer mould.

8. A machine according to claim 6, wherein said means supporting the outer mould yieldably about the core member comprises an outwardly extending ring on the core member, with the lower end of the outer mould resting on the ring.

* * * * *